US010519403B2

(12) United States Patent
Schwerter et al.

(10) Patent No.: US 10,519,403 B2
(45) **Date of Patent: *Dec. 31, 2019**

(54) SANITARY CLEANER

(71) Applicant: ECOLAB USA INC., Saint Paul, MN (US)

(72) Inventors: Andrea Schwerter, Monheim (DE); Thomas T. Hansen, Grevenbroich (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,479

(22) Filed: Dec. 10, 2018

(65) Prior Publication Data

US 2019/0106656 A1 Apr. 11, 2019

Related U.S. Application Data

(62) Division of application No. 15/121,218, filed as application No. PCT/EP2014/053638 on Feb. 25, 2014, now Pat. No. 10,190,077.

(51) Int. Cl.

| | |
|---|---|
| ***C11D 3/50*** | (2006.01) |
| ***C11D 3/04*** | (2006.01) |
| ***C11D 1/72*** | (2006.01) |
| ***C11D 11/00*** | (2006.01) |
| ***C11D 3/20*** | (2006.01) |
| ***C11D 3/32*** | (2006.01) |

(52) U.S. Cl.

CPC ..... *C11D 3/042* (2013.01); *C11D 1/72* (2013.01); *C11D 3/2003* (2013.01); *C11D 3/323* (2013.01); *C11D 3/50* (2013.01); *C11D 11/0023* (2013.01)

(58) Field of Classification Search

CPC ..... C11D 3/9042; C11D 1/72; C11D 3/50; C11D 11/0023; C11D 3/323

See application file for complete search history.

(56) References Cited

U.S. PATENT DOCUMENTS 10,190,077 B2 * 1/2019 Schwerter ..... C11D 1/72

FOREIGN PATENT DOCUMENTS

| | | | |
|---|---|---|---|
| CN | 103130705 | A | 6/2013 |
| JP | 2005082799 | | 3/2005 |
| JP | 2008094903 | | 4/2008 |
| WO | 03031550 | A1 | 4/2003 |
| WO | 2004011584 | A1 | 2/2004 |
| WO | 2005103218 | A1 | 11/2005 |
| WO | 2008027912 | A3 | 3/2008 |
| WO | 2009125305 | A2 | 10/2009 |

OTHER PUBLICATIONS

Lacina et al., "Critical assessment of extraction methods for the simultaneous determination of pesticide residues and mycotoxins in fruits, cereals, spices and oil seeds employing ultra-high performance liquid chromatography-tandem mass spectrometry", Journal of Chromatography A, vol. 1262, pp. 8-18, Sep. 5, 2012.

Yu Genfa et al., Flavoring Technology for Daily Use, China Light Industry Press, pp. 128, 162 Sep. 30, 2007.

Hu Weixiao et al., Handbook for the Preparation of Organic Compounds, Tianjin Science & Technology Translation & Publication Co., Ltd, Vol. 1, 1st Edition, p. 947, Mar. 1995.

Lu Chengping, Veterinary Microbiology, China Agriculture Press, 5th Edition, p. 276, Jan. 31, 2013.

Ecolab USA Inc., PCT/EP2014/053638 filed 25, 2014, "International Preliminary Report on Patentability and Written Opinion of the International Searching Authority", 8 pages, dated Aug. 30, 2016.

* cited by examiner

*Primary Examiner* — John R Hardee

(74) *Attorney, Agent, or Firm* — McKee, Voorhees & Sease, PLC

(57) ABSTRACT

The invention relates to an aqueous sanitary cleaning composition comprising a sulfamic acid in an amount of about ≤10 wt.-%, isotridecanol ethoxylate in an amount of about less than 3 wt.-%, a perfume in an amount in a range of about ≥0.2 wt.-% to ≤0.5 wt.-%, and water, wherein the wt.-% of the components are based on the total weight of the sanitary cleaning composition, and wherein the perfume comprises at least one of the compounds according to the general formulas I, II and III, and/or a compound according to the general formula IV.

11 Claims, No Drawings

SANITARY CLEANER

CROSS-REFERENCE TO RELATED APPLICATIONS

This application is a Divisional Application of U.S. Ser. No. 15/121,218, now U.S. Pat. No. 10,190,077, filed Aug. 24, 2016, which is a U.S. National Phase application claiming priority to PCT/EP2014/053638 filed Feb. 25, 2014, both of which are herein incorporated by reference in their entirety.

FIELD OF THE INVENTION

The invention relates to an aqueous sanitary cleaning composition and to the use of said cleaning composition for cleaning of surfaces in the sanitary area, especially of surfaces in bathrooms.

BACKGROUND

Aqueous cleaning compositions for the removal of dirt and soiling in sanitary areas are well-known. These compositions normally are based on a combination of inorganic and/or organic acids and surfactants. As additional agents these compositions often further comprise colouring agents, perfumes, viscosity control agents, disinfecting and bleaching agents, preservatives, and further auxiliary substances.

For the removal of persistent lime scale it is required that a cleaning composition has a high acidity. Since strong inorganic acids such as hydrochloric acid and sulphuric acid lead to corrosion of metallic surfaces, material incompatibility and cause environmental pollution, nowadays cleaning compositions that are based on sulfamic acid are widely used. Document WO 2005/103218 for example describes a highly acidic, polysaccharide thickening, aqueous cleaning and decalcifying agent for hard surfaces, containing a combination of 5 to 10 wt. % amidosulfonic acids and 4 to 10 wt. % lactic acid. The cleaning and decalcifying agent is used, in particular, as a decalcifying agent or as a sanitary cleaner. Such sulfamic acid-based cleaning compositions have a high-scale removing capability.

Another problem of sanitary areas is bad sanitary smell such as of urine or feces. While known sanitary cleaners are designed for standard soil, a usual sanitary cleaner does not cover high amounts of bad sanitary smell. Hence, particularly the odor control provided by sanitary cleaners may be improved.

Therefore, the object underlying the present invention was to provide a sanitary cleaner providing an improved odor control.

SUMMARY

In one aspect, the disclosure provides an aqueous sanitary cleaning composition comprising:

- a sulfamic acid or sulfamic acid derivative in an amount of about ≤10 wt.-%,
- isotridecanol ethoxylate in an amount of about less than 3 wt.-%,
- a perfume in an amount in a range of about ≥0.2 wt.-% to ≤0.5 wt.-%, and
- water,
- wherein the wt.-% of the components are based on the total weight of the sanitary cleaning composition, and wherein the perfume comprises at least one of the following compounds according to the general formulas I, II and III:

(I)

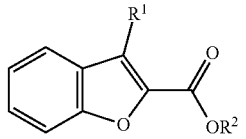

(II)

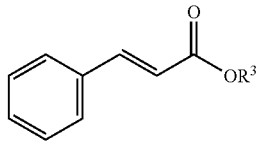

(III)

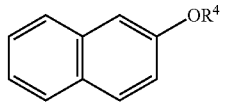

wherein:

$R^1$ is selected from the group consisting of hydrogen and $C_{1-5}$ alkyl, and $R^2$, $R^3$, $R^4$ independently is selected from the group consisting of $C_{1-5}$ alkyl; and/or a compound according to the general formula IV:

(IV)

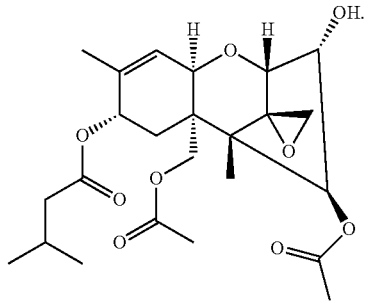

It has been surprisingly found that the combination of acid, surfactant and perfume provided by the disclosure may provide the advantage of safe handling of the aqueous sanitary cleaning composition, and cleaning success in regard of the soil in the sanitary area combined with a long-lasting control of bad smells. The aqueous sanitary cleaning composition can clean the existing soil in the sanitary area and cover the bad smells. The aqueous sanitary cleaning composition further can be used without personal protective equipment. The aqueous sanitary cleaning composition particularly can provide for an improved odor control in sanitary areas.

In another aspect, the disclosure provides an aqueous sanitary cleaning solution obtainable by diluting the sanitary cleaning composition in water. It has also been found that the aqueous sanitary cleaning solution can provide a good cleaning success in regard of the soil in the sanitary area combined with a long-lasting control of bad smells. The aqueous sanitary cleaning solution can clean the existing soil in the sanitary area and neutralize the bad smells.

In another aspect, the disclosure provides a method for the cleaning of a sanitary surface comprising applying to the surface to be cleaned an aqueous sanitary cleaning composition or an aqueous sanitary cleaning solution.

In another aspect, the disclosure provides the use of the sanitary cleaning composition or the aqueous sanitary cleaning solution for the cleaning of a sanitary surface.

Other aspects and embodiments are encompassed by the disclosure and will become apparent in light of the following description.

DETAILED DESCRIPTION

For the following defined terms, these definitions shall be applied, unless a different definition is given in the claims or elsewhere in this specification.

The term "aqueous" composition or solution refers to a composition or solution in which the solvent is water. An aqueous sanitary cleaning composition refers to a sanitary cleaning composition in which the solvent is water.

The term "surfactant" refers to an organic chemical that when added to a liquid changes the properties of that liquid at a surface.

The term "bad smell" refers to a malodor or a penetrating, objectionable odor, particularly a strong fecal odor, from which a typical person withdraws if able to.

The term "alkyl" refers to straight-chain or branched alkyl groups. The term "$C_1$-$C_5$-alkyl" as used herein refers to straight-chain or branched alkyl groups having 1 to 5 carbon atoms. $C_1$-$C_5$-alkyl groups can be selected from the group comprising methyl, ethyl and the isomers of propyl, butyl or pentyl, such as isopropyl, isobutyl, tert.-butyl, sec.-butyl and/or isopentyl.

The term "aryl" refers to aromatic groups for example phenyl or naphthyl.

The term "allyl" refers to a structural group —HC═CH—$CH_2$— comprising a methylene group attached to a vinyl group.

Weight percent, weight-% or wt.-% are synonyms that refer to the concentration of a substance as the weight of the substance divided by the weight of the composition and multiplied by 100. The weight-% (wt.-%) of the components are calculated based on the total weight amount of the composition, if not otherwise stated.

The total amount of all components of the composition does not exceed 100 wt.-%. The remainder up to 100 wt.-% of the composition or solution can be water. The water content of the composition or solution is simply determined by subtracting the amounts of all the other ingredients from 100 wt.-%.

As used herein, the term "ready to use" refers to a solution that can be directly applied to a surface to be cleaned without any further dilution.

All numeric values are herein assumed to be modified by the term "about", whether or not explicitly indicated. As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a", "an" and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The disclosure provides an aqueous sanitary cleaning composition that is highly effective in odor control. The aqueous sanitary cleaning composition comprises:

a sulfamic acid or sulfamic acid derivative in an amount of about ≤10 wt.-%, isotridecanol ethoxylate in an amount of about less than 3 wt.-%, a perfume in an amount in a range of about ≥0.2 wt.-% to ≤0.5 wt.-%, and water, wherein the wt.-% of the components are based on the total weight of the sanitary cleaning composition, and wherein the perfume comprises at least one of the following compounds according to the general formulas I, II and III:

(I)

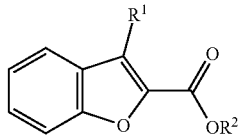

(II)

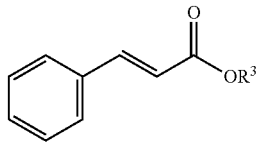

(III)

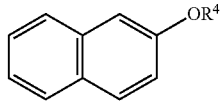

wherein:

$R^1$ is selected from the group consisting of hydrogen and $C_{1-5}$ alkyl, and $R^2$, $R^3$, $R^4$ independently is selected from the group consisting of $C_{1-5}$ alkyl; and/or a compound according to the general formula IV:

(IV)

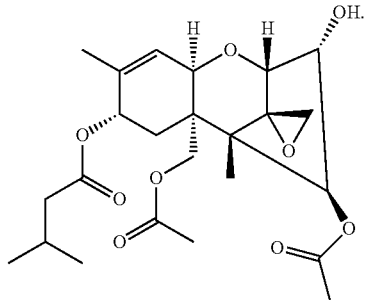

The combination of sulfamic acid and isotridecanol ethoxylate provides a good cleaning success in of the existing soil of sanitary surfaces.

The term "sulfamic acid" as used herein refers to a compound that is also known as amidosulfonic acid, amidosulfuric acid, aminosulfonic acid, and sulfamidic acid. The term "sulfamic acid derivative" refers to N-alkyl, N-aryl or N-allyl derivatives thereof.

The aqueous sanitary cleaning composition may comprise of about ≥5 wt.-% to about ≤10 wt.-%, or of about ≥6 wt.-% to about ≤9 wt.-%, or of about ≥7 wt.-% to about ≤8 wt.-%, based on the total weight of the sanitary cleaning composition, of sulfamic acid or sulfamic acid derivative. In embodiments, the sanitary cleaning composition may comprise sulfamic acid. In an embodiment, the sanitary cleaning composition may comprise of about 8 wt.-%, based on the total weight of the sanitary cleaning composition, of sulfamic acid.

The term "isotridecanol ethoxylate" as used herein refers to an ethoxylated branched $C_{13}$-alcohol of the IUPAC name 11-methyldodecan-1-ol that may contain one or more ethylene oxide groups (EO). The degree of ethoxylation refers to a statistical mean values which for a special product may be either a whole number or a fractional number. The isotridecanol ethoxylate may contain 3 to 40 ethylene oxide groups (3-40EO), 6 to 30 ethylene oxide groups (6-30EO), 7 to 20 ethylene oxide groups (7-20EO), or 8 to 10 ethylene oxide groups (8-10EO). In an embodiment, the aqueous sanitary cleaning composition may comprise isotridecanol ethoxylate with 8 ethylene oxide groups (8EO). The aqueous sanitary cleaning composition may comprise of about ≥0.5 wt.-% to about <3 wt.-%, or of about ≥0.5 wt.-% to about ≤2 wt.-%, or of about ≥0.8 wt.-% to about ≤1 wt.-%, based on the total weight of the sanitary cleaning composition, of isotridecanol ethoxylate. In embodiments, the sanitary cleaning composition may comprise of about ≥0.9 wt.-% to about ≤0.99 wt.-% isotridecanol ethoxylate, based on the total weight of the sanitary cleaning composition. In an embodiment, the sanitary cleaning composition may comprise of about 0.99 wt.-% isotridecanol ethoxylate, based on the total weight of the sanitary cleaning composition.

The aqueous sanitary cleaning composition comprises sulfamic acid or a sulfamic acid derivative in an amount of about ≤10 wt.-% and isotridecanol ethoxylate in an amount of about less than 2 wt.-%, based on the total weight of the sanitary cleaning composition. In another embodiment, the aqueous sanitary cleaning composition may comprise sulfamic acid or a sulfamic acid derivative in an amount of about ≤8 wt.-% and isotridecanol ethoxylate in an amount of about less than 1 wt.-%, based on the total weight of the sanitary cleaning composition. In embodiments, the aqueous sanitary cleaning composition may comprise of about ≥5 wt.-% to about ≤10 wt.-% sulfamic acid or a sulfamic acid derivative and of about ≥0.5 wt.-% to about <3 wt.-% isotridecanol ethoxylate, or of about ≥6 wt.-% to about ≤9 wt.-% sulfamic acid or derivative and of about ≥0.5 wt.-% to about <2 wt.-% isotridecanol ethoxylate, or of about ≥7 wt.-% to about ≤8 wt.-% sulfamic acid or derivative and of about ≥0.8 wt.-% to about <1 wt.-% isotridecanol ethoxylate, or of about ≥7 wt.-% to about ≤8 wt.-% sulfamic acid or derivative and of about ≥0.9 wt.-% to about ≤0.99 wt.-% isotridecanol ethoxylate, based on the total weight of the sanitary cleaning composition. Such combinations of surfactant and acid provide for a safe handling of the composition. Particularly, the composition can be used without personal protective equipment. This provides that a user needs not be specifically trained or follow demanding safety standards when using the cleaning composition.

The aqueous sanitary cleaning composition further comprises a perfume. The term "perfume" as used herein refers to a mixture of fragrant substances or compounds and auxiliary materials such as fixatives and solvents used to provide a favorable smell, for example to objects, living spaces, or textiles. The perfume comprises at least one of the compounds according to the general formulas I, II, and III and/or the compound according to the general formula IV. In addition, the perfume may contain auxiliary materials such as carriers, diluents, fixatives, extenders, stabilizers, and solvents. The aqueous sanitary cleaning composition can provide a long-lasting odor control. Without being bound to a special theory it is assumed that this effect is attributed to the perfume comprising at least one of the compounds according to the general formulas I, II, and III and/or the compound according to the general formula IV.

The perfume may comprise at least one of the compounds according to the general formulas I, II, and III. The perfume may comprise any mixture or combination thereof. For example the sanitary cleaning composition may comprise the compounds according to the general formulas I and II, or II and III, or I and III, or I, II and III. While either of the compounds and particularly mixtures of at least two of the compounds can provide an improvement in suppressing bad smell in the sanitary area, a combination of the compounds can provide even better covering of a bad sanitary smell. Particularly, the fecal malodor of skatol can be covered with a combination of the compounds according to the general formulas I, II and III.

The compound according to the general formula I has the following formula:

(I)

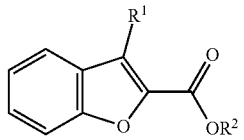

wherein $R^1$ is selected from the group consisting of hydrogen and $C_{1-5}$ alkyl, and $R^2$ is selected from the group consisting $C_{1-5}$ alkyl. The $C_1$-$C_5$-alkyl groups can be independently from each other a straight-chain group selected from the group consisting of methyl, ethyl, propyl, butyl, and pentyl. In an embodiment $R^1$ can be selected from the group consisting of hydrogen and $C_{1-3}$ alkyl. $R^1$ can be hydrogen. Alternatively $R^1$ can be methyl, ethyl, or propyl. In another embodiment, $R^2$ can be selected from the group consisting of $C_{1-3}$ alkyl. $R^1$ and $R^2$ independently from each other can be methyl, ethyl, or propyl. Compounds according to the general formula I wherein $R^1$ is hydrogen or $C_{1-3}$ alkyl, and $R^2$ is $C_{1-3}$ alkyl can show good effects in covering fecal smells.

The compound according to the general formula II has the following formula:

(II)

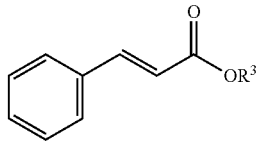

wherein $R^3$ is selected from the group consisting of $C_{1-5}$ alkyl. The $C_1$-$C_5$-alkyl group can be a straight-chain group selected from the group consisting of methyl, ethyl, propyl, butyl, and pentyl. In an embodiment, $R^3$ is selected from the group consisting of $C_{1-4}$ alkyl. $R^3$ can be methyl, ethyl, propyl, or butyl.

The compound according to the general formula III has the following formula:

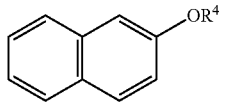

(III)

wherein $R^4$ is selected from the group consisting of $C_{1-5}$ alkyl. The $C_1$-$C_5$-alkyl group can be a straight-chain group selected from the group consisting of methyl, ethyl, propyl, butyl, and pentyl. In an embodiment, $R^4$ is selected from the group consisting of $C_{1-3}$ alkyl. $R^4$ can be methyl, ethyl, or propyl. Also the compounds according to the general formulas II and III wherein $R^3$ is $C_{1-4}$ alkyl, and $R^4$ is $C_{1-3}$ alkyl, respectively, can show good effects in covering fecal smells in the sanitary area.

The perfume can comprise alternatively or additionally to the compounds according to the general formulas I, II, and III the compound according to the general formula IV. The perfume can comprise any mixture or combination thereof. The perfume can comprise the compound according to the general formula IV and at least one of the compounds according to the general formulas I, II and III. A mixture of the compound according to the formula IV and at least one the compound according to the general formulas I, II or III can provide an improvement in odor control compared to the use of one of the compounds alone. For example the perfume can comprise mixtures of the compounds according to the formulas IV and I, or the formulas IV and II, or the formulas IV and III, or the formulas IV, I and II, or the formulas IV, I and III, or the formulas IV, II and III.

In an embodiment, the perfume can comprise a compound according to the general formulas I, II and III and the compound according to the general formula IV. A combination of the compounds according to the general formulas I, II, III and IV can provide even better covering of a bad sanitary smell. A combination of the compound according to the general formula IV and the compounds according to the general formulas I, II, and III can cover the bad smells in the sanitary area and provide a long lasting odor control.

In an embodiment, the sanitary cleaning composition may comprise of about ≥0.2 wt.-% to about ≤0.4 wt.-%, or of about ≥0.25 wt.-% to about ≤0.35 wt.-%, or of about 0.3 wt.-% to about ≤0.35 wt.-%, based on the total weight of the sanitary cleaning composition, of the perfume. In another embodiment, the sanitary cleaning composition may comprise of about 0.3 wt.-%, based on the total weight of the sanitary cleaning composition, of the perfume. Already an amount of 0.2 wt.-% to 0.4 wt.-%, or 0.3 wt.-% of the perfume may cover and control high amounts of bad sanitary smell such as urine and provide a long lasting odor control in the sanitary area.

The aqueous sanitary cleaning composition may comprise of about ≥5 wt.-% to about ≤10 wt.-% sulfamic acid, of about ≥0.5 wt.-% to about <3 wt.-% isotridecanol ethoxylate, and of about ≥0.2 wt.-% to about ≤0.4 wt.-% perfume, based on the total weight of the sanitary cleaning composition. The aqueous sanitary cleaning composition may comprise of about ≥6 wt.-% to about ≤9 wt.-% sulfamic acid, of about ≥0.5 wt.-% to about <2 wt.-% isotridecanol ethoxylate, and of about ≥0.25 wt.-% to about ≤0.35 wt.-% perfume, based on the total weight of the sanitary cleaning composition. The aqueous sanitary cleaning composition may comprise of about ≥7 wt.-% to about ≤8 wt.-% sulfamic acid, of about ≥0.8 wt.-% to about <1 wt.-% isotridecanol ethoxylate, and of about ≥0.3 wt.-% to about ≤0.35 wt.-% perfume, based on the total weight of the sanitary cleaning composition. In an embodiment, the aqueous sanitary cleaning composition may comprise about 8 wt.-% sulfamic acid, about 0.99 wt.-% isotridecanol ethoxylate, and about 0.3 wt.-% perfume, based on the total weight of the sanitary cleaning composition.

The sanitary cleaning composition may comprise urea. In some embodiments, the sanitary cleaning composition may comprise of about ≥2 wt.-% to about ≤5 wt.-%, or of about ≥2.5 wt.-% to about ≤4 wt.-%, or of about ≥3 wt.-% to about ≤3.5 wt.-%, based on the total weight of the sanitary cleaning composition, urea. Urea can increase the solubility and stability of the perfumes in the aqueous sanitary cleaning composition. In an embodiment, the sanitary cleaning composition may comprise of about 3 wt.-%, based on the total weight of the sanitary cleaning composition, of urea.

The sanitary cleaning composition may comprise a C2 to C3 alcohol. The C2 to C3 alcohol can be selected from the group consisting of ethanol, 1-propanol and 2-propanol or mixtures thereof. According to one embodiment, the sanitary cleaning composition can comprise ethanol. In some embodiments, the sanitary cleaning composition may comprise of about ≥0.5 wt.-% to about ≤3 wt.-%, or of about ≥0.7 wt.-% to about ≤2 wt.-%, or of about ≥1 wt.-% to about ≤1.5 wt.-%, based on the total weight of the sanitary cleaning composition, of a C2 to C3 alcohol, preferably of ethanol. In an embodiment, the sanitary cleaning composition may comprise of about 1 wt.-%, based on the total weight of the sanitary cleaning composition, of ethanol. The alcohol may improve the stability of the sanitary cleaning composition. The alcohol further may be used to solve the perfume and/or other auxiliary compounds in a premix solution that is then used to formulate the sanitary cleaning composition.

The sanitary cleaning composition may optionally comprise additional components such as one or more of surfactants, disinfection agents, dyes, preservatives and/or corrosion inhibitors. Various dyes and other aesthetic enhancing agents may be included in the composition. Dyes may be included to alter the appearance of the composition, as for example, Basic Violet, Acid Yellow or Acid Orange. For example, the composition may comprise Basic Violet 10, Acid Yellow 23, Acid Yellow 3, or Acid Yellow 17.

Water can be added to the sanitary cleaning composition to reach 100 wt.-% of the composition. The water content of the sanitary cleaning composition may thus simply be determined by subtracting the amounts of the compounds used from 100 wt.-%.

The aqueous sanitary cleaning composition particularly is suitable for the cleaning of sanitary areas. The sanitary cleaning composition can be used without diluting or may be used in a diluted form that is also referred to as a use-solution or a solution that is ready to use. For example if used periodically or for persistent soiling, the aqueous sanitary cleaning composition may be used without dilution or as a highly concentrated dilution. For a diluted sanitary cleaning composition, also referred to as aqueous sanitary cleaning solution, water can be added to the sanitary cleaning composition.

The invention further relates to an aqueous sanitary cleaning solution obtainable by diluting the sanitary cleaning composition as described above in water. The diluted aqueous sanitary cleaning solution particularly can show good cleaning effects of the existing soil in the sanitary area. The aqueous sanitary cleaning solution can clean the existing soil in the sanitary area and cover the bad smells. The aqueous sanitary cleaning solution can provide a long lasting odor control in sanitary areas. The solution may be used at any desired dilution of the sanitary cleaning composition in water. The solution may comprise of about ≥1 wt.-% to about <100 wt.-% of the sanitary cleaning composition, based on the total weight of the sanitary cleaning solution. In some embodiments, the aqueous sanitary cleaning solution may comprise of about ≥50 wt.-% to about <100 wt.-% of the sanitary cleaning composition, based on the total weight of the sanitary cleaning solution. Such highly concentrated dilutions may be used periodically or for persistent soiling. In other embodiments, the aqueous sanitary cleaning solution may comprise of about ≥1 wt.-% to about ≤3 wt.-% of the sanitary cleaning composition, based on the total weight of the sanitary cleaning solution. Such dilutions may be used for regular for example daily cleaning or minor soiling.

The aqueous sanitary cleaning composition and the aqueous sanitary cleaning solution may be applied in liquid form, by spraying or as a foam. The aqueous sanitary cleaning composition and the aqueous sanitary cleaning solution may particularly be applied in liquid form.

The aqueous sanitary cleaning composition and in particular a dilution such as the aqueous sanitary cleaning solution are useful for the cleaning of various sanitary areas and surfaces. The disclosure further relates to a method for cleaning a sanitary surface comprising applying to the surface to be cleaned an aqueous sanitary cleaning composition or an aqueous sanitary cleaning solution as described above. Examples for surfaces to be cleaned include hard and soft surfaces, for example of upper outer and/or inner outer surfaces of materials such as ceramic, plastic, glass and/or metal. The solution or the composition can come into contact with the surface by spraying it onto the surface. The aqueous sanitary cleaning solution or composition may be applied using a dosing pump or a manual dosed system. The aqueous sanitary cleaning solution or composition may be applied by using a dispenser or a solid support soaked with the sanitary cleaning solution or composition. The support can be a woven or non- woven fabric, a textile, a paper towel, cotton wool, an absorbent polymer sheet or a sponge. The sanitary cleaning solution or composition may be used at any temperature, preferably at ambient temperature. The sanitary cleaning solution or composition may be provided by a manual dosed system, surgery pouches. The sanitary cleaning solution or composition can be used for all sanitary areas.

The aqueous sanitary cleaning composition and in particular a dilution such as the aqueous sanitary cleaning solution can be used for the cleaning of sanitary areas and surfaces. The disclosure further relates to the use of the sanitary cleaning composition or the aqueous sanitary cleaning solution for the cleaning of a sanitary surface.

The aqueous sanitary cleaning composition can be formed by mixing together the compounds comprised in the composition. One may begin with water and then add the other compounds to the water. An additional pre-mix step optionally can be included, for example to dissolve the perfume in ethanol and then to add the pre-mix to the aqueous mixture prepared before. An aqueous sanitary cleaning solution can be prepared by diluting the aqueous sanitary cleaning composition in water.

All publications and patent applications in this specification are indicative of the level of ordinary skill in the art to which this invention pertains. The invention has been described to various specific and preferred embodiments and techniques. However, it should be understood that many variations and modifications may be made while remaining within the spirit and scope of the invention.

For a more complete understanding of the invention, the following examples are given to illustrate some embodiments. These examples and experiments are to be understood as illustrative and not limiting.

Unless otherwise noted, all parts, percentages, and ratios reported in the following examples are on a weight basis, and all reagents used in the examples were obtained, or are available, from the chemical suppliers described below, or may be synthesized by conventional techniques.

In the following tests aqueous sanitary cleaning solutions and comparable solutions according to the state of the art were prepared and compared with respect to their lime-removal capacity, cleaning capacity, and odor control ability.

The composition of the invention as shown in Table 1 and the compositions for comparison as shown in Table 3 were prepared by adding the components to water and mixing.

TABLE 1

Components of the aqueous sanitary cleaning composition of the invention

| Components (supplier) | Into CLP [wt.-%] |
|---|---|
| sulfamic acid (Kuang Ming Enterprise) | 8 |
| Isotridecanol ethoxylate (8 EO) (BASF) | 0.99 |
| perfume (Fragrance Resources) | 0.3 |
| Urea prilled (Yara) | 3 |
| ethanol (96%) 2% MEK tech grade (Brenntag) | 1 |
| Basic violet 10 (BASF) | 0.00025 |
| Acid Yellow 3 C (BASF) | 0.000624 |
| water, deionized | add. 100 |

Compositions Into CLP 1 to Into CLP 7 were prepared by using different perfume compositions. The perfume used for the different compositions Into CLP 1 to Into CLP 7 comprised the compound according to the formula IV and the compounds according to the formulas I, II and III having the groups $R^1$, $R^2$, $R^3$ and $R^4$, respectively, as shown in Table 2:

TABLE 2

Compounds I, II and III of the aqueous sanitary cleaning compositions

| | perfume | | | |
|---|---|---|---|---|
| | Compound I | | Compound II | Compound III |
| Composition | $R^1$ | $R^2$ | $R^3$ | $R^4$ |
| Into CLP 1 | $—C_3H_7$ | $—C_3H_7$ | $—C_3H_7$ | $—C_3H_7$ |
| Into CLP 2 | $—C_2H_5$ | $—C_4H_9$ | $—CH_3$ | $—C_2H_5$ |
| Into CLP 3 | $—CH_3$ | $—C_5H_{11}$ | $—C_3H_7$ | $—C_5H_{11}$ |
| Into CLP 4 | $—C_3H_7$ | $—C_5H_{11}$ | $—C_2H_5$ | $—C_2H_5$ |
| Into CLP 5 | $—C_2H_5$ | $—C_4H_9$ | $—C_4H_9$ | $—CH_3$ |
| Into CLP 6 | $—CH_3$ | $—C_4H_9$ | $—C_2H_5$ | $—CH_3$ |
| Into CLP 7 | $—C_3H_7$ | $—C_2H_5$ | $—CH_3$ | $—C_4H_9$ |

Aqueous sanitary cleaning solutions with different amounts of the compositions were prepared by diluting the respective composition comprising the components according to the amounts listed in Table 1 in water.

TABLE 3

| Compositions for comparison | | |
|---|---|---|
| Components (supplier) | Into maxx [wt.-%] | Into citrus [wt.-%] |
| sulfamic acid (Kuang Ming Enterprise) | 4 | 9 |
| Lactic acid 80% (Purac) | 3.41 | 0 |
| Isotridecanol ethoxylate (8 EO) (BASF) | 0 | 2.65 |
| Longchain alcohol alkoxylated (BASF) | 2.5 | 0 |
| Perfume Fresh lemon (Drom) | 0.4 | 0 |
| Perfume 04-8549 (HFC) | 0 | 0.5 |
| Urea prilled (Yara) | 5 | 5 |
| ethanol (96%) 2% MEK tech grade (Brenntag) | 1 | 2 |
| Basic violet 10 (BASF) | 0.00025 | 0.00025 |
| Acid Yellow 3 C (BASF) | 0.000625 | 0.000625 |
| water, deionized | add. 100 | add. 100 |

The compositions for comparison as shown above in Table 3 were prepared by adding the components to water and mixing. Milizid® was purchased at Dr. Schnell Chemie GmbH, Germany. Solutions were prepared by diluting the compositions in water.

EXAMPLE 1

Cleaning Ability

The following example was carried out to illustrate the cleaning ability by wet abrasion scrub tester. Aqueous sanitary cleaning solutions comprising 1 wt.-% or 3 1 wt.-% of the composition, the undiluted composition and the compositions and solutions for comparison were poured on an artificially soiled white PVC test strip with a sponge and afterwards the whiteness of the test strips was analyzed by a chromatometer.

White PVC strips (White PVC-film Benova 4812080, 1.3 m/50 m/0.12 mm as purchased from Benecke-Kaliko AG) were coated with 2 g of Standard test soil (IPP 83/21, wfk Krefeld) using a flat paintbrush with flat bristles, about 55 mm wide. Two grams test soil was applied with the flat brush on the white PVC foil. Horizontal strokes were alternated with vertical strokes 7 times in each direction. The final coat was at right angles to the scouring movement. The soil was allowed o to dry for one hour.

For the evaluation of the cleaning capacity the following test was undertaken for the aqueous sanitary cleaning solutions and composition Into CLP 1 and the solutions for comparison as given in Table 3 above.

A polyester sponge submerged in water was removed from the water ands allowed to drain. The sponge was compressed for 10 seconds in a sponge press and placed in a Gardner apparatus (Gardner wet abrasion scrub tester apparatus model 494 (DIN-ASTM-515), Erichsen GmbH & Co. KG) with a weight of 400 g. Twelve ml of the aqueous sanitary cleaning solution or the solutions for comparison was poured on top of the soiled strip and the sponge. The cycle counter on the Gardner apparatus was set to 10. Upon completion of the wipe cycle, the sponge was discarded. The test strip was rinsed under running deionized water and hung for drying. Each solution was tested on 6 strips. For comparison, 6 strips were cleaned with tab water only.

The whiteness of the test strips was analyzed by a Minolta Chroma Meter CR-200 (Minolta). The instrument was calibrated with the provided white tile. The reflection of the test strips was taken at 7 different spots per strip. The average of the result gives the percentage of the cleanability. Single large deviating results were rejected from the calculation.

Valuation of the results:

For the aqueous sanitary cleaning solution and composition and the solutions for comparison, the average was calculated for all measurements:

$$\bar{x} = \frac{1}{N}\sum_{i=1}^{N} x_i$$

N=number of measurements (6×7=42)
x=degree of whiteness per measure spot
xarithm=Average cleaning performance
Standard deviation:

$$s_X^2 := \frac{1}{N-1}\sum_{i=1}^{N}(x_i - \bar{x})^2$$

As the measurements are influenced by the quality of water and the environmental conditions in the laboratory such as temperature and humidity, only results achieved at once and on the same day were compared.

The test results of the aqueous sanitary cleaning solutions and composition and the solutions for comparison are shown in Table 4 below.

TABLE 4

| Gardner test of cleaning ability: | | | | | |
|---|---|---|---|---|---|
| performance [%] | water | Into CLP 1 | Into maxx | Into citrus | Milizid ® |
| 1 wt.-% solution | 35.46 | 38.23 | 40.58 | 37.47 | 37.92 |
| 3 wt.-% solution | 35.46 | 38.84 | 40.15 | 45.00 | 37.63 |
| 100 wt.-% | 35.46 | 57.94 | 72.35 | 62.59 | 59.25 |

As can be seen from the results in Table 4, the cleaning capacity of the aqueous sanitary cleaning solutions and compositions of the invention Into CLP 1 is comparable to the cleaning capacity of the solutions according to the state of the art. As expected, the undiluted compositions showed more pronounced cleaning ability compared to the solutions comprising 1 wt.-% or 3 wt.-% of the composition, based on the total weight of the sanitary cleaning solution. This shows that the composition may be used periodically or for persistent soiling, while the solutions show satisfactory cleaning effect to be used for regular cleaning or minor soiling.

The Gardner test of cleaning ability as described above was repeated with the aqueous sanitary cleaning solutions and compositions of the invention Into CLP 2 to Into CLP 7 and the respective solutions for comparison. The results of the cleaning ability of CLP 2 to Into CLP 7 showed only minor deviation to Into CLP 1.

EXAMPLE 2

Lime Removal Capacity

The lime-removal capacity was tested using the marble block method. Marble blocks (Bianco Cararra) of 30×30×20 mm dimension with one polished side were brushed under water and rinsed with ethanol to remove oil-/fat stain. After that the marble-blocks were dried for 5 hours in a drying chamber at 120° C. The hot marble blocks were put in a desiccator and weighted when cold on the analytical scale. "Cold" as used herein refers to room temperature. Room temperature, as used herein, refers to temperatures in the range of 20° C. to 25° C.

For the examination of the lime-removing capacity the marble-block were placed in 200 ml of the aqueous sanitary cleaning solution or composition of the invention Into CLP 1 or the solutions for comparison Into maxx, Into citrus, and Milizid® for 1 hour at room temperature. After that the marble blocks were taken out of the solutions, rinsed with demineralised water, dried at 120° C. for 5 h and put in a desiccator. The cold marble blocks were weighted. The samples were run in duplicate.

The lime-removing capacity was determined as the amount of marble in milligrams that dissolves within 1 hour. The difference in weight of the marble block at the beginning and in the end of the dissolving procedure is equal to the lime-removing capacity.

The test results of the lime-removal capacity at room temperature for the aqueous sanitary cleaning solution and composition the solutions for comparison are shown in Table 5 below.

TABLE 5

| lime-removal capacity | | | | |
|---|---|---|---|---|
| lime-removal capacity [%] | Into CLP 1 | Into maxx | Into citrus | Milizid ® |
| 5 wt.-% solution | 0.27 | 0.17 | 0.29 | 0.52 |
| 100 wt.-% | 14.36 | 8.06 | 14.05 | 13.63 |

The lime removal capacity was evaluated as %=(100/Start weight)×end weight.

As can be seen from the Table 5, the observed lime-removal capacity of the aqueous sanitary cleaning solution delivered comparable results to the capacity of the solutions according to the state of the art and even slightly better.

The test of lime-removal capacity as described above was repeated with the aqueous sanitary cleaning solutions and compositions of the invention Into CLP 2 to Into CLP 7 and the respective solutions for comparison. The results of the lime-removal capacity of CLP 2 to Into CLP 7 showed only minor deviation to Into CLP 1.

EXAMPLE 3

Odor Control

The odor control was tested through an "inhouse fieldtest" at different bathrooms and sanitary areas inhouse. The bathrooms and sanitary areas were cleaned for 3 months daily either with the aqueous sanitary cleaning solutions of the invention Into CLP 1 to Into CLP 7 or a solution for comparison Into maxx, Into citrus, Milizid®, respectively, each using a 1 wt.-% dilution for hard surfaces and the floor and the undiluted composition (100 wt.-%) for the toilet bowl, e.g. toilet bowl using a brush, surfaces by using a microfiber cloth and floor with a mop. After cleaning 20 persons checked the smell in the rooms. 100% of the asked persons noticed a significant improvement of the aqueous sanitary cleaning solution and composition of the invention versus the standard solution. The test persons did not recognize a difference to the cleaning ability and odor neutralizing of the solutions Into CLP 1 to Into CLP 7. Even high frequented bathrooms which were cleaned with Into CLP 1 to Into CLP 7 had still a pleasant smell, while the solutions for comparison had just a short time influence on the bad smell.

In summary, the above evaluations show that the aqueous sanitary cleaning solution and composition according to the invention showed a good lime-removing capacity and good cleaning properties. Moreover, the aqueous sanitary cleaning solution and composition showed a better odor control compared to the solutions of the state of the art.

The invention claimed is:

1. A method of using a sanitary cleaning composition or an aqueous sanitary cleaning solution comprising;

cleaning a sanitary surface with a composition or an aqueous solution wherein the composition comprises: sulfamic acid or sulfamic acid derivative in an amount of about ≤10 wt.-%, isotridecanol ethoxylate in an amount of about less than 3 wt.-%, a perfume in an amount in a range of about ≥0.2 wt.-% to ≤0.5 wt.-%, wherein the perfume has one of the following formulas I, II and/or III:

(I)

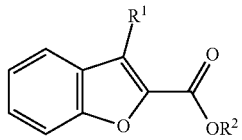

(II)

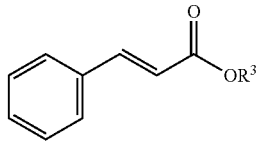

(III)

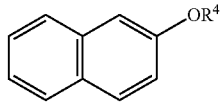

and wherein $R^1$ is selected from the group consisting of hydrogen and $C_{1-5}$ alkyl, and $R^2$, $R^3$, $R^4$ independently is selected from the group consisting of $C_{1-5}$ alkyl, and a compound according to formula IV:

(IV)

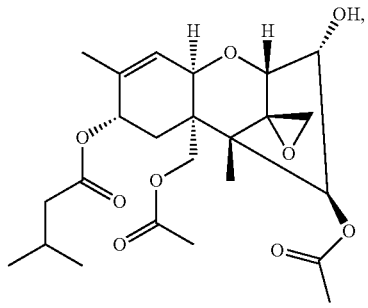

and water.

2. The method of claim 1, wherein the composition comprises about ≥5 wt.-% to about ≤10 wt.-% based on the total weight of the composition, of sulfamic acid or a sulfamic acid derivative.

3. The method of claim 1, wherein the composition comprises about ≥0.5 wt.-% to about <3 wt.-% based on the total weight of the composition, of isotridecanol ethoxylate.

4. The method of claim 1, wherein $R^1$ is a hydrogen or a $C_{1-3}$ alkyl.

5. The method of claim 1, wherein $R^2$ is a $C_{1-3}$ alkyl.

6. The method of claim 1, wherein $R^3$ is a $C_{1-4}$ alkyl.

7. The method of claim 1, wherein $R^4$ is a $C_{1-3}$ alkyl.

8. The method of claim 1, wherein the composition comprises about ≥0.2 wt.-% to about ≤0.4 wt.-%, based on the total weight of the composition, perfume.

9. The method of claim 1, wherein the composition further comprises about ≥2 wt.-% to about ≤5 wt.-%, based on the total weight of the composition, urea.

10. The method of claim 1, wherein the composition further comprises about ≥0.5 wt.-% to about ≤3 wt.-%, based on the total weight of the composition, of a C2 to C3 alcohol.

11. The method of claim 1, further comprising a step of diluting the composition in water to obtain the aqueous sanitary cleaning solution.

* * * * *